US005852841A

United States Patent [19]

Rissik

[11] Patent Number: 5,852,841

[45] Date of Patent: Dec. 29, 1998

[54] APPARATUS FOR AUTOMATIC CLEANING OF A SUBMERGED SURFACE

[75] Inventor: George Victor Rissik, Gauteng, South Africa

[73] Assignee: Galago Limited and Kenneth Dinner, New South Wales, Australia

[21] Appl. No.: 69,037

[22] Filed: Apr. 27, 1998

Related U.S. Application Data

[63] Continuation-in-part of Ser. No. 857,915, May 16, 1997, abandoned.

[30] Foreign Application Priority Data

May 17, 1996 [ZA] South Africa ..... 96/3940

[51] Int. Cl.[6] ..... E04H 4/16

[52] U.S. Cl. ..... 15/1.7

[58] Field of Search ..... 15/1.7, 415.1

[56] References Cited

U.S. PATENT DOCUMENTS

| | | | |
|---|---|---|---|
| 3,019,462 | 2/1962 | Nash et al. | 15/1.7 |
| 4,615,802 | 10/1986 | Harbaugh | 15/1.7 X |
| 4,849,024 | 7/1989 | Supra | 15/1.7 X |

FOREIGN PATENT DOCUMENTS

| | | | |
|---|---|---|---|
| 475736 | 3/1992 | European Pat. Off. | 15/1.7 |
| 2604351 | 4/1988 | France | 15/1.7 |
| 1590623 | 6/1981 | United Kingdom | 15/1.7 |

*Primary Examiner*—Mark Spisich
*Attorney, Agent, or Firm*—Christie, Parker & Hale, LLP

[57] ABSTRACT

A cleaning apparatus for automatic cleaning of a submerged surface includes a body defining an internal chamber having an inlet and a pair of outlets, with each outlet being connectable with a suction source. A liquid flow transferring element is located inside the chamber for alternately transferring flow of liquid to each of the pair of the outlets from the inlet. The apparatus further includes a cleaning foot which is associated with the body and communicating with the inlet, the cleaning foot having an outer surface adapted to be located adjacent to and to travel over the submerged surface. The body is pivotal relative to the foot about at least one axis that is substantially parallel to said outer surface, through an angle of at least 80°, between a first position which allows travel of the cleaning foot relative to the surface in a first direction, to a second position which allows travel of the cleaning foot relative to the surface in a second direction.

7 Claims, 2 Drawing Sheets

APPARATUS FOR AUTOMATIC CLEANING OF A SUBMERGED SURFACE

FIELD OF THE INVENTION

This application is a Continuation-In-Part Application of application Ser. No. 08/857,915, filed May 16, 1997, now abandoned. This invention relates to a cleaning apparatus for automatic cleaning of a submerged surface such as a wall or floor of a swimming pool, or the like.

BACKGROUND TO THE INVENTION

Many types of cleaning apparatus—referred to as pool cleaners—have a suction head which is connected to the inlet of a swimming pool filtration system by means of a flexible hose and which moves in a generally random way across the surface to be cleaned.

One of the problems associated with such apparatuses is their ineffectiveness in pools where the side walls meet each other and the bottom in definite corners or sharp curves as opposed to gentler continuous curves. Such configurations often result in the pool cleaner becoming stuck in the corners of the pool.

Attempts to alleviate this problem include the provision of formations which project from the apparatus or from the flexible hose near the apparatus and which engage the pool near or in a pool corner to urge the cleaner away therefrom before it gets stuck. These devices while helpful in some instances are not particularly satisfactory.

An object of this invention is to provide a cleaning apparatus which is less likely to get stuck in pool corners and the like than prior art apparatuses.

SUMMARY OF THE INVENTION

According to the invention, there is provided a cleaning apparatus for automatic cleaning of a submerged surface which includes a body defining an internal chamber having an inlet and a pair of outlets, with each outlet being connectable with a suction means;

a liquid flow transferring means located inside the chamber for alternately transferring flow of liquid to each of the pair of the outlets from the inlet;

a cleaning foot associated with the body and communicating with the inlet, the cleaning foot having an outer surface adapted to be located adjacent to and to travel over the submerged surface; with the body being pivotal relative to the foot about at least one axis that is substantially parallel to said outer surface, through an angle of at least 80°, between a first position which allows travel of the cleaning foot relative to the surface in a first direction, to a second position which allows travel of the cleaning foot relative to the surface in a second direction.

The body may be pivotal relative to the foot through an angle of between 80° and 100°. The body may further be pivotal relative to the foot through about 40° on either side of a line which extends substantially perpendicularly to said outer surface.

The body may be moveable in a swivelling manner relative to the foot about an axis that is perpendicular to said outer surface.

The cleaning apparatus may include a socket which is defined in a projection which extends from the cleaning foot and the body may include a complementary part cylindrical extension which seats snugly inside the socket, with the socket and projection being pivotally connected to each other.

Alternatively, the body may have a part-spherical member and the cleaning foot may have a complementary socket, the part-spherical member being snugly received inside the socket.

According to one embodiment of the invention, there is provided a cleaning apparatus, in which the body has a trapezoidal portion:

the foot has a pair of spaced walls with the trapezoidal portion being pivotally located therebetween; and a pair of flaps which are mounted on and extend from the trapezoidal portion for effecting sealing between the trapezoidal portion and the head.

DETAILED DESCRIPTION OF THE INVENTION WITH REFERENCE TO THE DRAWINGS

The invention is now described by way of example with reference to the accompanying diagrammatic drawings.

Figure 1:
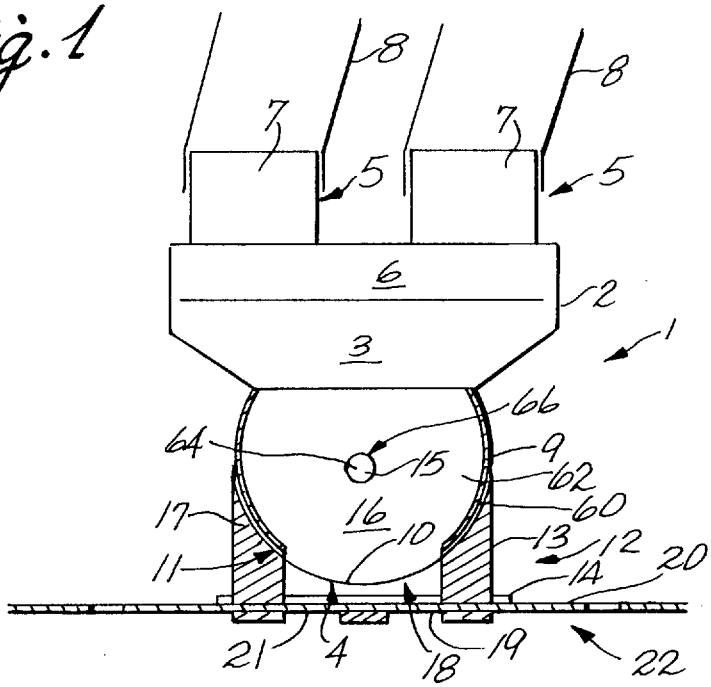
FIG. 1 shows a partially sectioned schematic side view of a cleaning apparatus, in accordance with a first embodiment of the invention, for automatic cleaning of a submerged surface.

Referring to the drawings, a cleaning apparatus, in accordance with the invention, for automatic cleaning of a submerged surface, is generally designated by reference numeral 1.

The apparatus 1 includes a body 2 which defines an internal chamber 3 having an inlet 4 and two outlets 5. The inlet 4 and the outlets 5 are on opposite sides of the body 2 with the inlet 4 in use being positioned below the outlets 5 which are located at a top end 6 of the body.

The outlets 5 are in the form of tapered spigots 7, each of which is connected to a flexible hose 8 which defines a suction passage. The hoses 8 are interconnected at a position remote from the body in a manner which is well-known in the art of swimming pool cleaning apparatus. The apparatus 1 is therefore connected to a suction inlet of a filtration apparatus for a swimming pool via the hoses 8.

Figure 4:
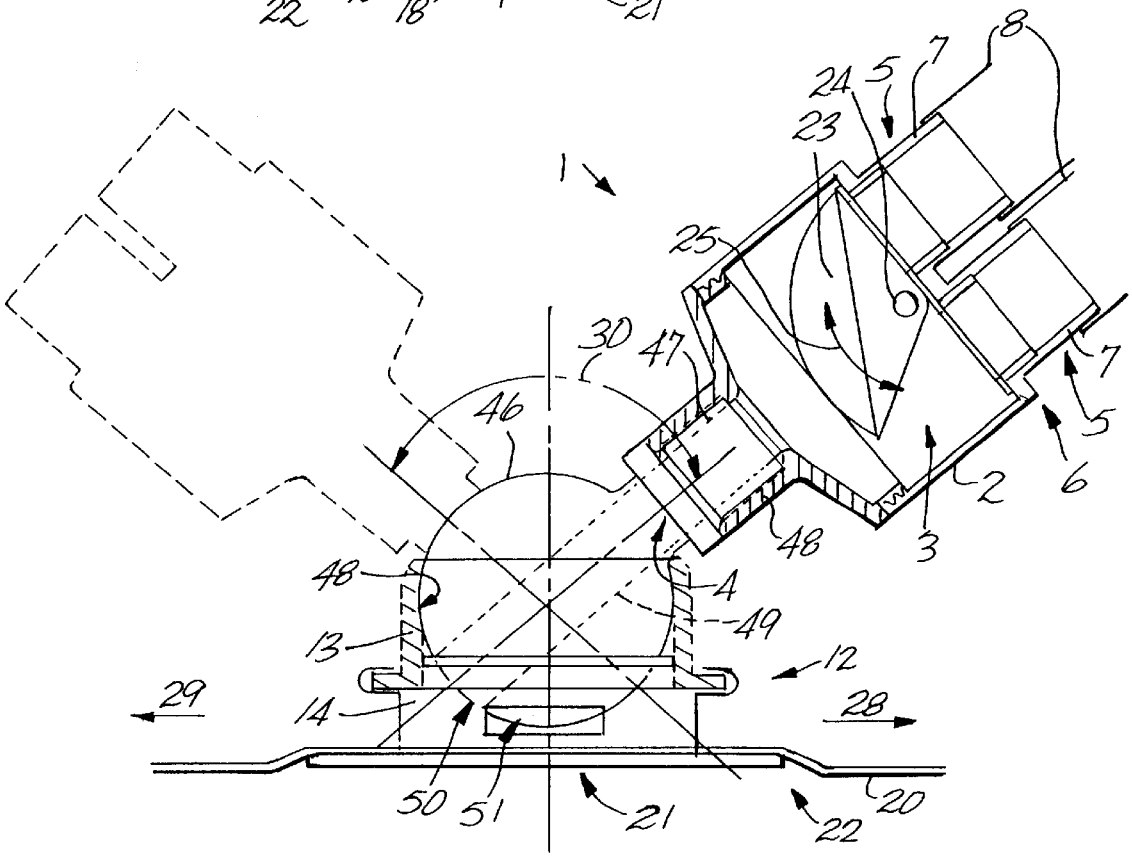
FIG. 4 shows a partially sectioned schematic side view of a cleaning apparatus, in accordance with a fourth embodiment of the invention.

The apparatus 1 also includes a liquid flow transferring means in the form of a flapper valve 23 as shown in FIG. 4. The flapper valve 23 is pivotally mounted inside the chamber 3 at a pivot point 24, and is pivotable through an arc as indicated by the arrow 25 for alternately transferring flow of water to each of the outlets 5 from the inlet 4. It will be appreciated that there are different types of flow transferring means which are known in the art and which could be used inside the body 2 to the same effect.

The apparatus 1 also includes a cleaning foot 12 having a circular flexible pad 20 which has a central aperture 21. The cleaning foot 12 has an outer, substantially planar, surface 22 which is adapted to be located adjacent to and move over a surface to be cleaned.

The body 2 is pivotal relative to the foot 12 about an axis 66, which extends substantially parallel to the surface 22.

Figure 2:
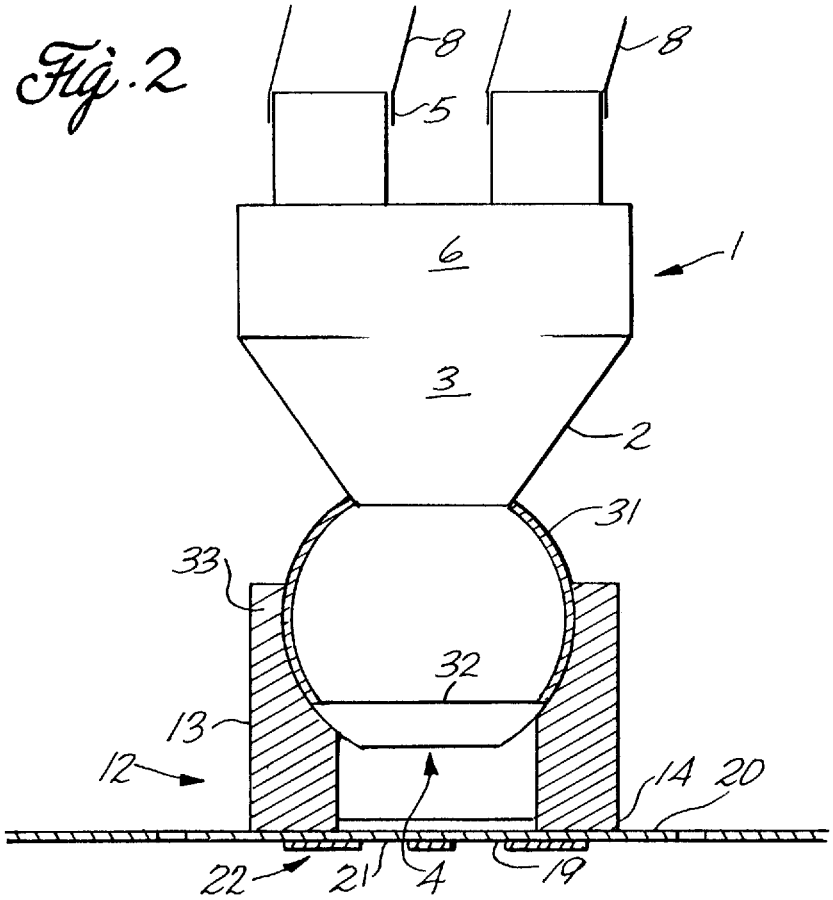
FIG. 2 shows a partially sectioned schematic side view of a cleaning apparatus, in accordance with a second embodiment of the invention.
Figure 3:
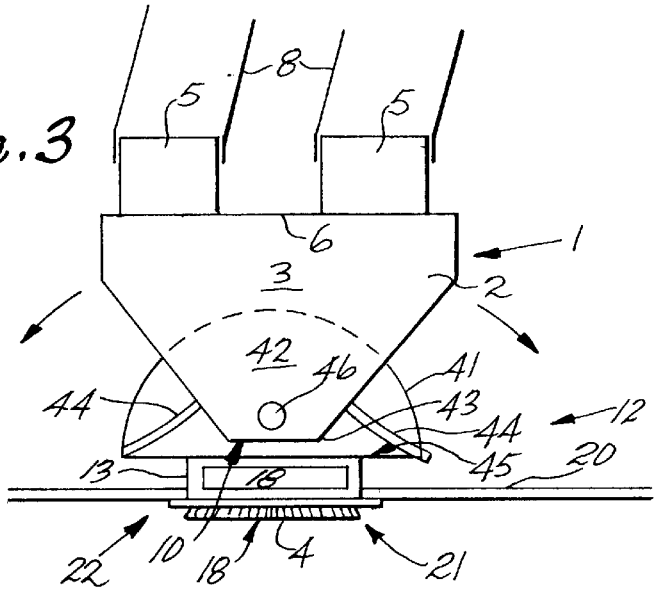
FIG. 3 shows a partially sectioned schematic side view of a cleaning apparatus, in accordance with a third embodiment of the invention.

The body 2 is pivotal through an angle of about 100° as indicated by the arrow 30, between a first position as shown in FIG. 4 in solid lines, which allows travel of the cleaning foot 12 relative to the surface to be cleaned in a first direction as indicated by the arrow 28, to a second position as illustrated in dotted lines in FIG. 4, which allows travel of the cleaning foot 12 relative to the surface to be cleaned in a second direction as indicated by the direction of the arrow 29. It has been found by the applicant that the apparatus 1 functions optimally when the body 2 is located at an angle of about 45° to the surface 22. The embodiments of the invention as illustrated in FIGS. 1 to 3, therefore show the body 2 in an intermediate position between the first and the second position. It will be appreciated that movement of the apparatus 1 is only effected when the body 2 is at an angle to the surface 22. However, in use, the body 2 is unlikely to remain perpendicular and will move to one side or the other.

In the first embodiment which is illustrated in FIG. 1, a socket 11 is formed in a projection 13 from a base member 14 of the foot 12. In this case the inlet 4 is formed by a part-cylindrical extension 9 which extends from the body 2. The extension 9 is complementary to the socket 11 so that it is received snugly in the socket 11. The extension 9 has arcuate walls 60 which span approximately 260° which extend between two planar end walls 62. The walls 60 define an elongate opening 10 between them.

The extension 9 is secured to the socket 11 by means of a pivot pin 64 passing through co-axial apertures 15 in end walls 16 of the extension 9 and end walls 17 of the projection 13 of the base member 14. The pin 64 defines the axis 66. The base member 14 includes a passage 18 which is in flow communication with the opening 10 of the extension 9 and with a bottom 19 of the base member 14.

It will be appreciated that movement between the body 2 and the foot 12 of the apparatus 1 shown in the first embodiment is limited to pivotal movement in a single plane about the pin 64. In use, the body 2 will be at an acute angle such as 45° relative to the surface 22 as it moves in known manner behind the flexible hoses 8 which connect it to the filtration apparatus.

When the apparatus 1 reaches a corner such as that of a flat bottomed swimming pool, the body 2 will pivot with respect to the foot 12 thus directing the flexible hoses 8 in the opposite direction and reversing the direction of movement of the apparatus 1 across the submerged surface being cleaned.

A second embodiment of the invention is shown in FIG. 2. The configuration of the second embodiment is similar to that of the first embodiment and similar parts have been given similar reference numbers. The essential difference between the second and first embodiment is that in the second embodiment an extension 31 from the body 2 is not part-cylindrical but is part-spherical with an opening 32 at a position remote from the body 2.

The part-spherical extension 31 is held captive in a complementary shaped part-spherical socket 33 defined in the projection 13 of the foot 12 of the apparatus 1.

The part-spherical configuration of the extension 31 and socket 33 enables the body 2 to pivot with respect to the foot 12 about an infinite number of pivotal axes parallel to the surface 22 and also to swivel generally about an axis perpendicular to the surface 22. This results in greater manoeuvrability of the cleaning apparatus 1 and consequently less likelihood of the apparatus becoming stuck in the corner of a swimming pool.

A third embodiment of the invention is shown in FIG. 3 of the drawings. Again in this embodiment elements that are similar to those elements of the first embodiment are given similar reference numerals.

The construction of the third embodiment is similar to that of the first embodiment in that pivotal movement of the body 2 with respect to the surface 22 about a single axis is permitted.

The projection 13 from the foot 12 of the apparatus 1 terminates in a pair of spaced semi-circular side walls 41. These spaced side walls 41 receive a lower portion 42 of the body 2. This lower portion 42 of the body 2 has the configuration of an inverted trapezoid and is pivotally mounted between the spaced side walls 41 by means of a pin 46 near a lower most point 43 thereof. In this way the body 2 can pivot between the walls 41 with the inlet 4 being in communication with the passage 18. To ensure that the opening 10 and passage 18 remain in substantially sealed communication at all pivotal positions of the body 2 with respect to the foot 12, a pair of flexible flaps 44 are provided on opposite sides of the lower trapezoidal portion 42 of the housing. These flaps 44 are mounted on the lower portion 42 of the body 2 to extend in opposite directions and engage the walls 41 and a floor 45 of the projection 13.

As the housing 2 pivots with respect to the foot 12 the flaps 44 flex and move over the projection while at all times substantially sealing the passage 18 and opening 10.

A fourth embodiment of the invention is shown FIG. 4. The configuration of the fourth embodiment is similar to that of the second embodiment and again similar parts have been given similar reference numbers. In this case a part-spherical member 46 having a neck portion 47 is mounted to a base member 48 defining the outlet 4 of the body 2. The member 46 is held captive in a complementary shaped part-spherical socket 48 defined in the projection 13 of the foot 12 of the apparatus. A central flow passage 49 having an inlet 50 is defined in the member 46.

Again, as in the case of the embodiment shown in FIG. 2, the body 2 can swivel with respect to the foot 12 about a perpendicular axis. The cleaning foot 12 also includes a debris collection reservoir 51, with debris in use being sucked into the reservoir 51 when the inlet 50 of the member 46 is aligned with the debris collection reservoir 51.

Other embodiments are envisaged within the scope of the invention including other shapes and configurations and applications thereof.

I claim:

1. A cleaning apparatus for automatic cleaning of a submerged surface which includes a body defining an internal chamber having an inlet and a pair of outlets, with each outlet being connectable with a suction means;

a liquid flow transferring means located inside the chamber for alternately transferring flow of liquid to each of the pair of the outlets from the inlet;

a cleaning foot associated with the body and communicating with the inlet, the cleaning foot having an outer surface adapted to be located adjacent to and to travel over the submerged surface; with the body being pivotal relative to the foot about at least one axis that is substantially parallel to said outer surface, through an angle of at least 80°, between a first position which allows travel of the cleaning foot relative to the surface in a first direction, to a second position which allows travel of the cleaning foot relative to the surface in a second direction.

2. The cleaning apparatus as claimed in claim 1, in which the body is pivotal relative to the foot through an angle of between 80° and 100°.

3. The cleaning apparatus as claimed in claim 1, in which the body is pivotal relative to the foot through about 40° on either side of a line which extends substantially perpendicularly to said outer surface.

4. The cleaning apparatus as claimed in claim 1, in which the body is moveable in a swivelling manner relative to the foot about an axis that is perpendicular to said outer surface.

5. The cleaning apparatus as claimed in claim 1, in which a socket is defined in a projection which extends from the cleaning foot and the body includes a complementary part cylindrical extension which seats snugly inside the socket, with the socket and projection being pivotally connected to each other.

6. The cleaning apparatus as claimed in claim 1, in which the body has a part-spherical member and the cleaning foot has a complementary socket, the part-spherical member being snugly received inside the socket.

7. The cleaning apparatus as claimed in claim 1, in which the body has a trapezoidal portion:

the foot has a pair of spaced walls with the trapezoidal portion being pivotally located therebetween; and a pair of flaps which are mounted on and extend from the trapezoidal portion for effecting sealing between the trapezoidal portion and the foot.

* * * * *